United States Patent [19]

Potma et al.

[11] 3,993,181

[45] Nov. 23, 1976

[54] MATRIX PRINTER INCORPORATING INTERMITTENT INK RIBBON TRANSPORT

[75] Inventors: Theodorus Gerhardus Potma; Wilhelmus Adrianus Henricus Gijzen; Johannes Gerhardus Pape, all of Rijswijk, Netherlands

[73] Assignee: U.S. Philips Corporation, New York, N.Y.

[22] Filed: June 12, 1975

[21] Appl. No.: 586,351

[30] Foreign Application Priority Data

June 21, 1974 Netherlands ..... 7408352

[52] U.S. Cl. ..... 197/167; 197/1 R; 197/158

[51] Int. Cl.[2] ..... B41J 35/14; B41J 35/18

[58] Field of Search ..... 101/93.04, 93.05; 197/1 R, 151, 157, 158, 166, 167

[56] References Cited

UNITED STATES PATENTS

| | | | |
|---|---|---|---|
| 694,464 | 3/1902 | Dubois | 197/167 X |
| 3,174,611 | 3/1965 | Lapointe | 197/167 X |
| 3,190,430 | 6/1965 | McGrath | 197/167 X |
| 3,789,969 | 2/1974 | Howard et al. | 197/1 R |
| 3,841,459 | 10/1974 | Buschmann et al. | 197/158 X |

FOREIGN PATENTS OR APPLICATIONS

| | | | |
|---|---|---|---|
| 1,336,688 | 11/1973 | United Kingdom | 197/1 R |

*Primary Examiner*—Edgar S. Burr
*Assistant Examiner*—Paul T. Sewell
*Attorney, Agent, or Firm*—Frank R. Trifari

[57] ABSTRACT

A matrix printer comprising a printing head which can be moved to and from along a record carrier in a direction parallel to a printing line direction. The printing head is provided with straight recording pins which are arranged to be mutually parallel at equal distances from each other. The printing ends of the recording pins are situated in one line parallel to the printing line direction. Between the printing head and the record carrier an ink ribbon is arranged which is intermittently displaced, together with the record carrier, in a direction transverse to the movement direction of the printing head. The ink ribbon wear and reduction of the coloring agent are thus spread over the full width of the ink ribbon.

6 Claims, 7 Drawing Figures

MATRIX PRINTER INCORPORATING INTERMITTENT INK RIBBON TRANSPORT

The invention relates to a matrix printer comprising a printing head which is movable to and fro along a record carrier in a direction transverse to the transport direction of the record carrier and which comprises a number of straight, mutually parallel recording pins for printing, characters which are composed of matrix points through the intermediary of an ink ribbon which is arranged parallel to the printing line direction, one end of the said recording pins being connected to the armature of an electromagnet connected to the printing head, the other, free end being situated, together with the free ends of the other recording pins, in one line substantially parallel to the printing line direction.

In a known matrix printer of the kind set forth (British Patent Specification No. 1,336,688) the ink ribbon is always situated at the same level with respect to the line through the free ends of the recording pins. The ink ribbon is transported, as usual, in the printing line direction.

It is a characteristic of such a matrix printer that the recording pins always strike the ink ribbon on the same line, while the portions of the ink ribbon situated above and below this line are not utilized. This has the drawback that the ink ribbon comparatively quickly ceases to contain colouring agent at the area of the said line, and that the wear of the ink ribbon is concentrated in one line.

It is to be noted that, in order to avoid the said drawback, it is known to use an ink ribbon in matrix printers which is arranged at an angle, i.e. an ink ribbon whose longitudinal axis encloses an angle with the printing line direction. In such printers substantially the full ink ribbon width is utilized, so that the deterioration of the colouring agent as well as the wear is spread over a comparatively large surface area. However, in this case the ink ribbon is wider than in a printer comprising an ink ribbon which is arranged parallel to the printing line direction. Moreover, the ink ribbon must be displaced over a larger distance (upwards or downwards) in comparison with the said case so as to make the complete line visible after a line has been printed.

The invention has for its object to realize a matrix printer of the kind set forth in which comparatively little wear of the ink ribbon and comparatively small deterioration of the colouring agent in the ink ribbon occurs, and in which at the same time the last line printed can be simply made visible directly after printing.

To this end, the matrix printer according to the invention is characterized in that it comprises a transport device for the intermittent movement of the ink ribbon parallel to the movement direction of the record carrier.

Figure 1:
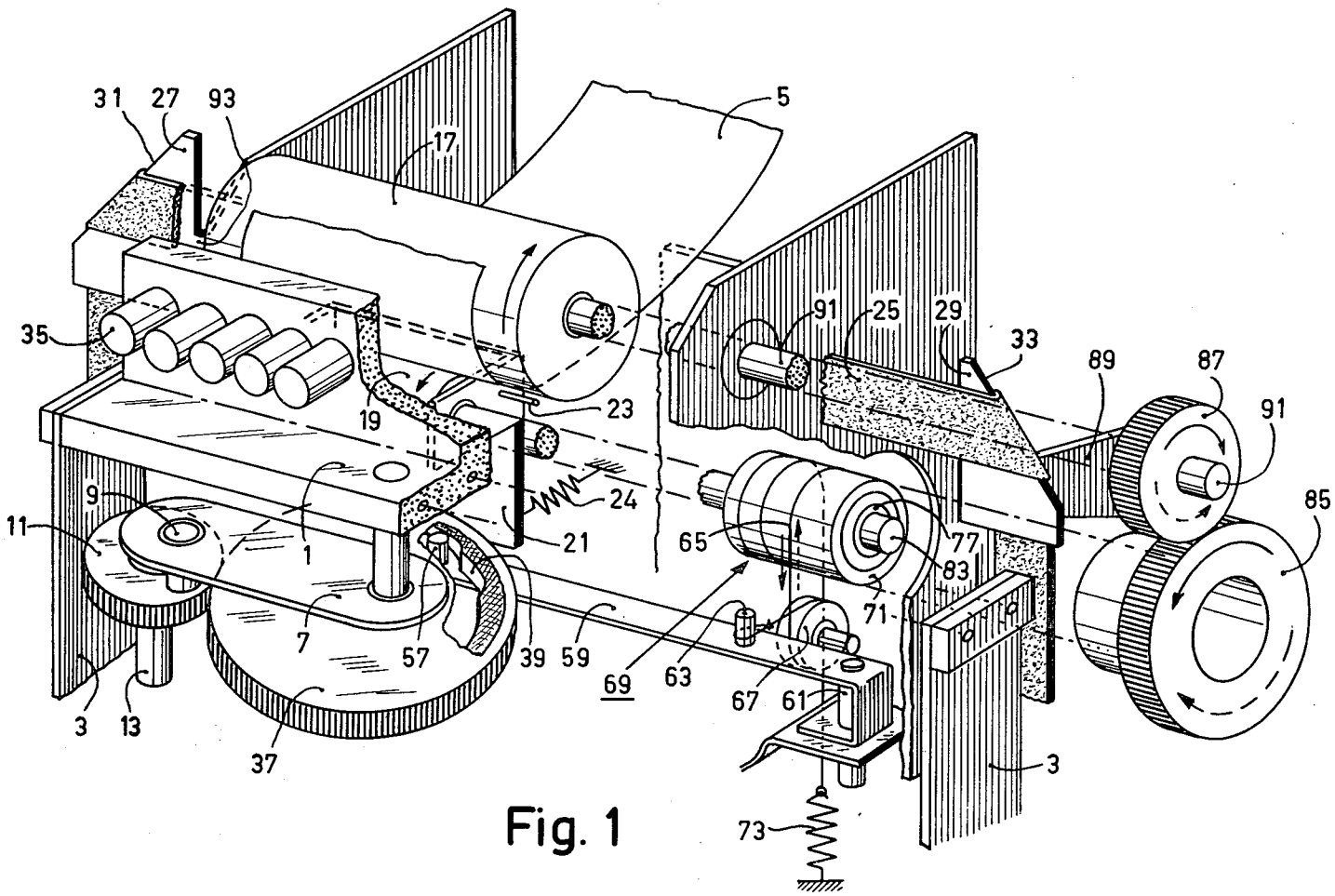
Figure 2:
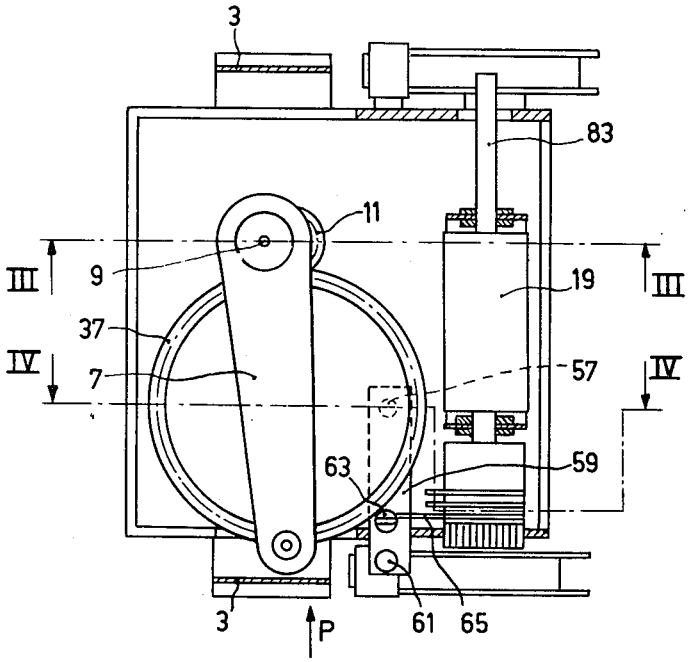
Figure 3:
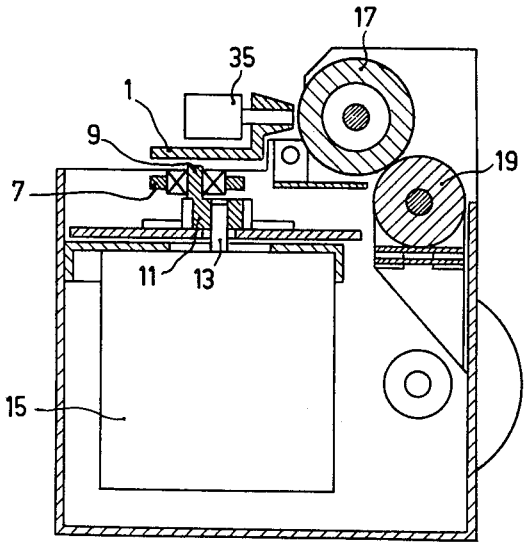
Figure 4:
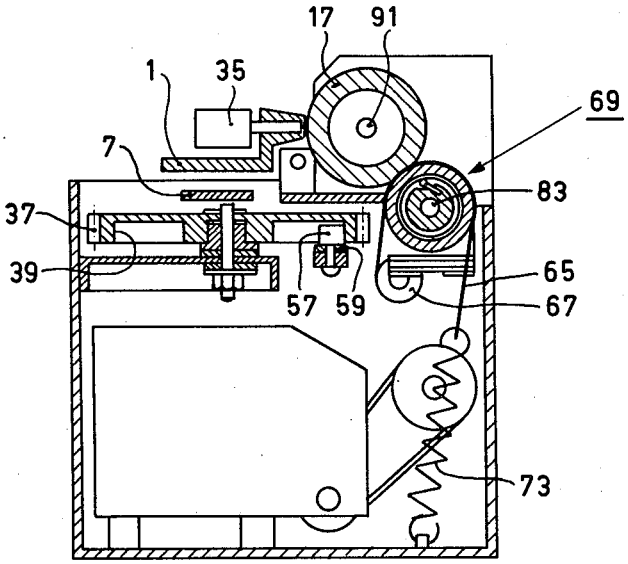
Figure 5:
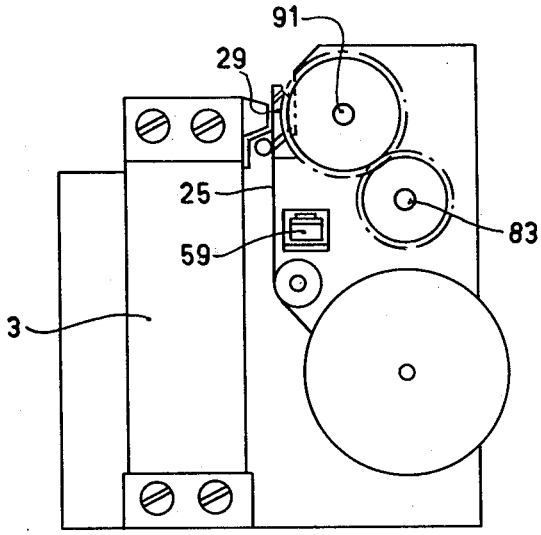
Figure 6:
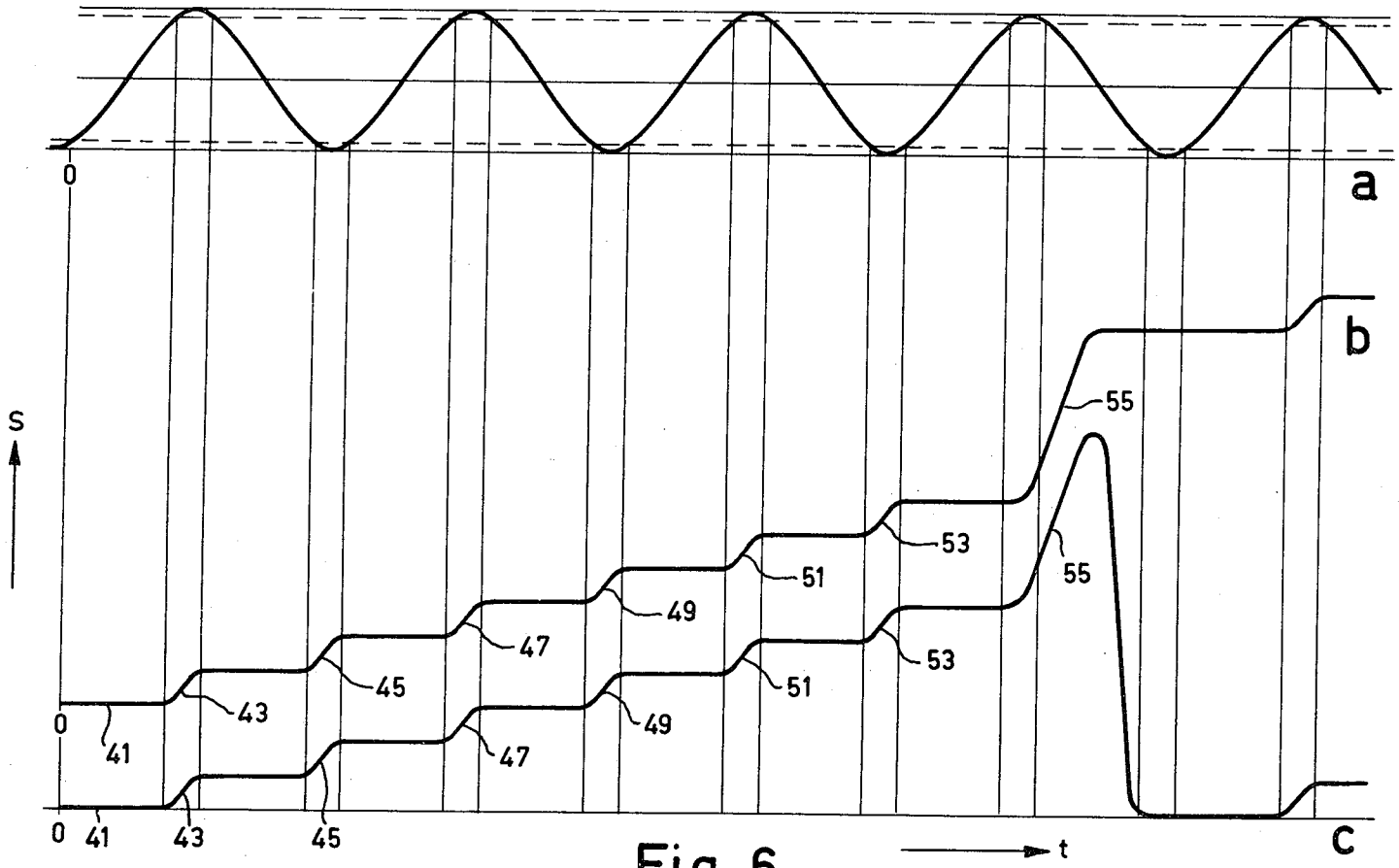
Figure 7:
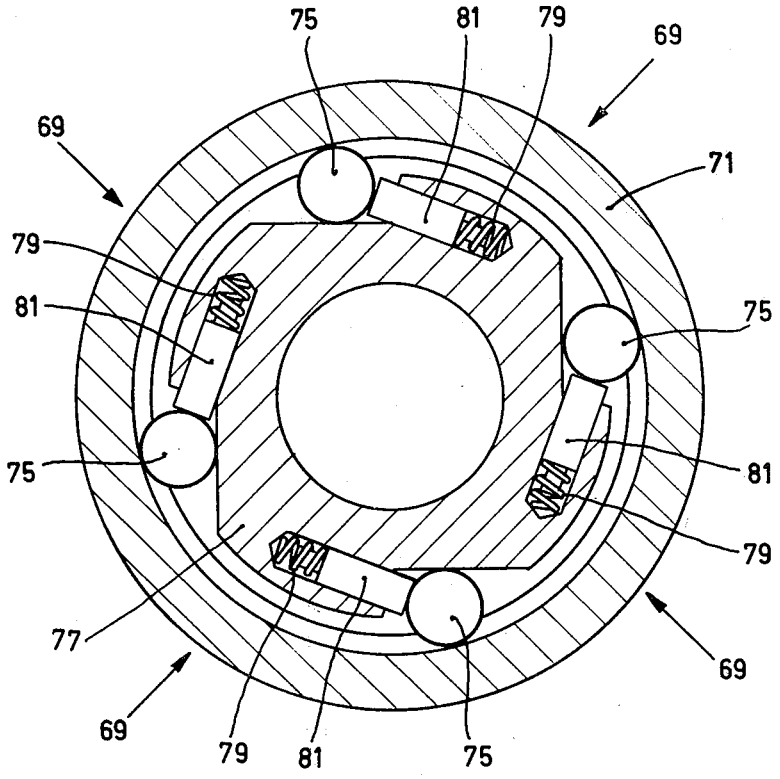

The invention will be described in detail hereinafter with reference to a drawing, in which:

FIG. 1 is a diagrammatic, perspective front view of a preferred emodiment of a matrix printer according to the invention, FIG. 2 is a plan view of the matrix printer shown in FIG. 1, FIG. 3 is a sectional view taken along the line III—III of the matrix printer shown in FIG. 2, FIG. 4 is a sectional view taken along the line IV—IV of the matrix printer shown in FIG. 2, FIG. 5 is a side elevation according to the arrow P of the matrix printer shown in FIG. 2, FIG. 6 curves *a b* and *c* show the movement graphs of the matrix printer shown in the previous Figures, FIG. 7 is a sectional view of a freewheel coupling used in a matrix printer as shown in the previous Figures.

The matrix printer shown in FIG. 1 comprises a bar-shaped printing head 1 and which is supported by two leaf springs 3. The longitudinal axis of the printing head is situated in the horizontal plane parallel to the printing line direction. The leaf springs 3 are arranged in a vertical plane which is perpendicular to the printing line direction, their end which is remote from the printing head 1 being clamped in the frame of the printer (see FIG. 5). The printing head can be moved to and fro along a record carrier 5 by means of a drive rod or arm 7 which is rotatably connected to a crank pin 9. The crank pin 9 is eccentrically arranged on a pinion 11 which is driven by a motor shaft 13 of an electric motor 15 (see FIG. 3). The record carrier 5 is guided along a roller 17 which is rotatably arranged opposite the printing head 1 and which serves as an anvil. The movement of the record carrier 5 (referred to hereinafter as the paper 5) is obtained by means of a driven pressure roller 19. The pressure roller 19 is rotatably arranged in a bracket 21 which is pivotable about a shaft 23. The bracket 21 is pretensioned in the clockwise direction by means of a pressure spring 24, so that the driven pressure roller 19 bears on the paper 5 and the roller 17 under a given contact pressure.

Between the printing head 1 and the paper 5 there is situated a horizontally arranged ink ribbon 25 which is guided over two ink ribbon guides 27 and 29. The ink ribbon guides 27 and 29 comprise slanted edges 31 and 33, respectively. During the printing, the ink ribbon is moved in the printing line direction by a known transport device which is not shown.

The printing head 1 comprises seven identical recording members, each of which comprises an electromagnet 35 and a straight recording pin (one shown in phantom) which is movable against spring force and which is connected to the armature of the electromagnet. The recording pins are arranged to be parallel to each other and at the same distance from each other. The ends of the seven recording pins are situated on the same line parallel to the printing line direction. When the coil of an electromagnet 35 is excited, the relevant recording pin strikes the ink ribbon 25, with the result that a point-like image is produced on the paper 5. The distance between the recording pins amounts to 7.6 mm. The stroke of the printing head 1 equals 8 mm. The maximum number of characters which can be printed per line is 21. The character matrix used comprises seven characters in the vertical direction and five characters in the horizontal direction. Printing is effected both during the forward motion and during the return motion of the printing head 1. Each recording pin is used for printing three character columns. A character is formed by successively printing the necessary points in seven levels. To this end, the paper 5 is intermittently displaced over six steps of 0.3 mm for each line to be printed. Upon each passage of the printed head 1, one level of points in the character is completed. For printing one line, consequently, seven passages of the printing head 1 are required, which means four forward passages and three return passages.

During the fourth return motion, the paper is advanced over a distance of 2.4 mm.

Hereinafter, a description will first be given as to how the paper is intermittently displaced, after which the coupling of the transport mechanism for the paper to the transport mechanism for the intermittent movement of the ink ribbon 25 will be described. The movement of the ink ribbon 25 in the direction perpendicular to the printing line direction is partly synchronous with the advancing movement of the paper 5.

The pinion 11 mounted on the motor shaft 13 engages a gearwheel 37 which has a partly hollow construction. The gearwheel 37 comprises an inner profile or cam track 39 (see FIG. 1) which increases in height (terrace-like) and in which six equal steps (43, 45, 47, 49, 51, 53) are provided as from a reference level 41 (see FIG. 6 curves *b* and *c*), and also a seventh step 55, the value of which deviates from that of the six equal steps. Radially viewed, the steps 43, 45, 47, 49, 51 and 53 equal 0.3 mm, while the step 55 equals 2.4 mm. The steps 43, 45, 47, 49, 51 and 53 represent the vertical distance of 0.3 mm between two matrix points which are situated one below the other in a character. The larger step 55 represents the distance of 2.4 mm which consists of the line spacing (2 mm) plus the diameter of a point image (0.4 mm). The cam track 39 cooperates with a roller or cam follower 57 which is rotatably journalled on a lever 59. The lever 59 is pivotable about a shaft 61 and is provided with a pin 63 whereabout a cable 65 is arranged. The cable 65 is guided over a pulley 67 and further over the outer drum 71 of a freewheel coupling 69 (see also FIG. 7). the cable 65 is tensioned by means of a coil spring 73 (see also FIG. 4). The freewheel coupling or one way clutch 69 which is shown in detail in FIG. 7 comprises — as already stated — an outer drum 71, the rotary movement of which can be transferred, by way of rotatable clamping rollers 75 to an inner drum 77. The clamping rollers 75 contact the inner side of the outer drum 71 under a given force, in that a pin 81 presses against the clamping rollers under the influence of a pretensioned spring 79. When the outer drum 71 rotates in the clockwise direction, the inner drum 77 is not taken along, while upon counter-clockwise rotation of the outer drum 71 the inner drum 77 is taken along. The inner drum 77 is rigidly coupled to a shaft 83 on which the pressure roller 19 (see FIG. 1) for the paper transport is connected.

As appears from the graph of FIG. 6 curve *a* in which the displacement (S) of the printing head 1 is plotted as a function of the time *t*, to printing head 1 performs a sinusoidal motion. The reversing points between the foreward and the return motions of the printing head 1 coincide with the maxima and minima of the sinusoidal curve shown in FIG. 6 curve *a* FIG. 6 curve *a* shows the complete displacement curve of the printing head 1 for one line to be printed. The movement cycle of the printing head 1 and the movement cycle of the roller 57 (lever 59, cable 65, shaft 83 and pressure roller 19) are attuned to each other such that each of the in total six paper advancements of 0.3 mm occurring during one printing cycle (steps 43, 45, 47, 49, 51 and 53) coincides with one of the reversing points of the printing head 1. For the sake of clarity, the time scale of the displacement curve for the paper 5 shown in FIG. 6 curve *b* is taken to be equal to the time scale of FIG. 6 curve *a*. The advancing of the paper over a distance of 2.4 mm (step 55) is effected during the fourth return movement of the printing head 1 in the printing cycle for one line (see FIG. 6 curves *a* and *b*).

Curve *c* of FIG. 6 shows the displacement curve of the ink ribbon 25. The time scale of the curve corresponds to the time scale of the curves *a* and *b* of FIG. 6. The ink ribbon movement is realized by a partial coupling of this movement to the paper advancing movement. To this end, the outer drum 71 of the freewheel coupling 69 is provided with a gearwheel 85 which engages a gearwheel 87. The gearwheel 87 is mounted on a lever 89. The lever 89 is arranged on a rotatably journalled shaft 91, which also has a second lever 93 connected thereto. The ink ribbon guides 29 and 27, provided with slanted edges 33 and 31, are connected to the levers 89 and 93, respectively. The roller 17 is journalled to be freely rotatable on the shaft 91. At the start of printing, the recording pins in the printing head 1 are opposite the ink ribbon near the upper edge thereof at a level which is denoted in FIG. 6*c* by the reference 41. In contrast with the shaft 83 for driving the pressure roller 19, the outer drum 71 of the freewheel coupling 69, and hence also the shaft 91, follows each movement of the roller 57 on the cam track 39. Shaft 83 follows only the counterclockwise rotations of the outer drum 71, but shaft 91 follows counter-clockwise as well as clockwise rotations of the outer drum 71. This means that as from level 41 paper 5 as well as ink ribbon 25 are simultaneously transported upwards over six steps (43, 45, 47, 49, 51 and 53) of 0.3 mm, and also over a larger step of 2.4 mm (55). The last step 55 of the printing cycle of a printing line is performed during the first part of the fourth return movement of the printing head 1. During the second part of the fourth return movement of the printing head 1, roller 57 returns to level 41 on cam track 39, and the ink ribbon 25 also follows this movement to level 41. The return movement of roller 57 to level 41 has no effect on the position of the paper 5, because a rotation of the outer drum 71 of the freewheel coupling in the clockwise direction is not transferred to shaft 83 which drives the pressure roller 19 for the paper transport.

The invention is not restricted to the described preferred embodiment. The intermittent ink ribbon transport device can also be successfully used in a matrix printer of the kind said forth incorporating continuous paper transport. In that case the ink ribbon must each time be advanced over a distance which is at the most equal to the character height in order to maintain proper direct visibility of the printed character after the printing and the dropping of the ink ribbon. The step mechanism formed by the gearwheel 37, roller 57, lever 59 and cable 65 then in principle remains unchanged and serves only for the ink ribbon transport. The continuous paper transport can be effected by way of a separate drive or by way of a drive derived from the pinion 11. It is not necessary to couple the gearwheel 37 to the pinion 11. A separate drive for the cam track 39 is alternatively possible. Such a drive should be synchronized with the drive for the printing head in a manner other than mechanical.

The freewheel coupling is not limited to the embodiment shown in FIG. 7. A ratchet mechanism and a threaded rod with a running nut which can be uncoupled can alternatively be used. Instead of the seven by five character matrix used in this case, other matrices can alternatively be used by using a cam track 39 comprising more or less steps.

What is claimed is:

1. A matrix printer for cooperation with an associated record carrier which comprises: a record carrier transport for moving the record carrier in one direction, a printing head which is movable along the record carrier in a direction transverse to said one direction of the record carrier and which includes a number of straight, mutually parallel recording pins for printing characters which are composed of matrix points, an ink ribbon which is arranged parallel to the printing line direction, a plurality of electromagnets carried by said head, one end of each of said recording pins being connected to the armature of one of said electromagnets, each of said recording pins being in one line substantially parallel to the printing line direction, a ribbon transport device including means for the intermittent movement of the ink ribbon parallel to the movement direction of the record carrier, said ribbon transport device including a unidirectional coupling comprising a bidirectional means and a unidirectional means, said bidirectional means driving said ribbon in said one direction and opposite said one direction and said unidirectional means driving said record carrier in said one direction.

2. A matrix printer as claimed in claim 1 further including a step mechanism driving said ribbon transport device and which comprises a rotatably journalled gearwheel having an internal cam track, a rotatable roller which cooperates with said cam track, a lever carrying said roller, and a cable coupling said lever to the unidirectional coupling.

3. A matrix printer as claimed in claim 2, wherein said step mechanism further includes a pinion on a motor shaft which drives said rotatable journalled gearwheel.

4. A matrix printer as claimed in claim 3, wherein said pinion is provided with a crank pin which is eccentrically arranged with respect to the motor shaft and said printer includes an arm for the reciprocating movement of the printing head by cooperation between said arm and said crank pin.

5. A matrix printer as claimed in claim 1, wherein said characters are formed from a matrix having a plurality of points disposed with uniform elevational spacing therebetween and the distance traveled by said ink ribbon in over at least some of said intermittent movements equals an integral multiple of said uniform elevational spacing.

6. A matrix printer as claimed in claim 1, wherein said record carrier transport and ink ribbon transport occur simultaneously.

* * * * *

UNITED STATES PATENT AND TRADEMARK OFFICE

CERTIFICATE OF CORRECTION

PATENT NO. : 3993181

DATED : November 23, 1976

INVENTOR(S) : THEODORUS GERHARDUS POTMA ET AL

It is certified that error appears in the above-identified patent and that said Letters Patent are hereby corrected as shown below:

[57] (Abstract) line 2, "from" should be --fro--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*